US005127717A

United States Patent [19]

Martinez

[11] Patent Number: 5,127,717

[45] Date of Patent: Jul. 7, 1992

[54] INDEXABLE VERTICAL BOOKCASE FOR OVERSIZED BOOKS

[76] Inventor: Beatrice E. Martinez, 1401 Middlebury Dr., Alexandria, Va. 22307

[21] Appl. No.: 693,567

[22] Filed: Apr. 30, 1991

[51] Int. Cl.[5] ..... A47B 88/00

[52] U.S. Cl. ..... 312/111; 312/234.2

[58] Field of Search ..... 312/111, 234.1, 234.2, 312/234.4, 233, 330.1; 403/DIG. 1

[56] References Cited

U.S. PATENT DOCUMENTS

| | | | |
|---|---|---|---|
| 142,526 | 10/1945 | Myers . | |
| 881,363 | 3/1908 | Vickers | 312/234.3 |
| 1,116,524 | 11/1914 | Willman | 312/234.4 |
| 2,719,069 | 9/1955 | Roberson | 312/234.2 X |
| 2,944,859 | 7/1960 | Ivanoff . | |
| 3,012,348 | 12/1961 | Smith | 312/234.4 X |
| 3,080,203 | 3/1963 | Graham . | |
| 3,167,873 | 2/1965 | Toms | 312/234.4 X |
| 4,145,100 | 3/1979 | Klaus . | |
| 4,236,768 | 12/1980 | Morrone . | |
| 4,241,955 | 12/1980 | Armistead . | |
| 4,278,174 | 7/1981 | LeBlanc | 312/111 X |
| 4,322,118 | 3/1982 | Shugart | 312/111 |
| 4,993,558 | 2/1991 | Assael . | |

OTHER PUBLICATIONS

J. K. Cassady, "Beginning Reading with BIG Books", Childhood Education, Fall 1988, pp. 18-23.

*Primary Examiner*—Joseph Falk

*Attorney, Agent, or Firm*—Oliff & Berridge

[57] ABSTRACT

A modular vertical bookcase for oversized books includes indexing and filing indicia to easily and quickly retrieve or return a book from or to the bookcase. The bookcase includes vertical dividers for separating the bookcase into subdivided spaces for housing oversized books. Indicia labelling strips can be located above or below the dividers and all subdivisions may be cataloged and referenced in a master indexing list located on top of the bookcase, or in pull out shelves immediately above the dividers.

6 Claims, 5 Drawing Sheets

INDEXABLE VERTICAL BOOKCASE FOR OVERSIZED BOOKS

FIELD OF THE INVENTION

The present invention relates to a vertical bookcase for storing oversized books. More specifically, the present invention relates to a modular vertical bookcase for oversized books which includes indexing and filing indicia to easily and quickly retrieve or return a book from or to the bookcase.

BACKGROUND

Numerous bookcases exist which can be used to house or store books. Since most books are of similar sizes (in height and depth) and are dimensioned to be substantially self-supporting, bookcases have become quite standardized.

Recently, there has been an explosion of oversized books. Large format road atlases are a well-known example of such books. There are also a number of oversized versions of children's books which are increasingly being marketed and used by individuals, schools and libraries. Many of these oversized books are paperback; particularly because of their large format and relatively few pages, they tend to bend at the top if stood up on end. These books are also often too large to store on a standard bookshelf. Storing, indexing and retrieving such oversized books is problematical. At present, such books are often horizontally stacked in a pile to accommodate the small size of available shelving for books and to avoid bending. Horizontal stacking of books does not facilitate their easy retrieval. It is difficult to easily locate or retrieve books which are stacked in a pile.

The need exists for a bookcase which can house oversized books vertically, as well as for a method of easily locating such stored books.

SUMMARY OF THE INVENTION

The present invention relates to a modular vertical bookcase for oversized books which includes indexing and filing indicia to provide the capability of easily and quickly retrieving or returning a book from or to the bookcase. The bookcase includes vertical dividers for separating the bookcase into subdivided spaces for housing oversized books. This facilitates indexing and provides support for the oversized books along their height. Indicia labelling strips can be located above or below the dividers, and all subdivisions may be cataloged and referenced in a master indexing list located on top of the bookcase or in pull out shelves immediately above the dividers. Modular bookcases of the invention can also be stacked to provide enhanced storage in limited space.

BRIEF DESCRIPTION OF THE DRAWINGS

The invention will be described hereinafter in detail with reference to the following drawings in which.

Both sides are essentially identical in appearance, and the back may have a corresponding but elongated appearance.

DETAILED DESCRIPTION OF PREFERRED EMBODIMENTS

Figure 1:
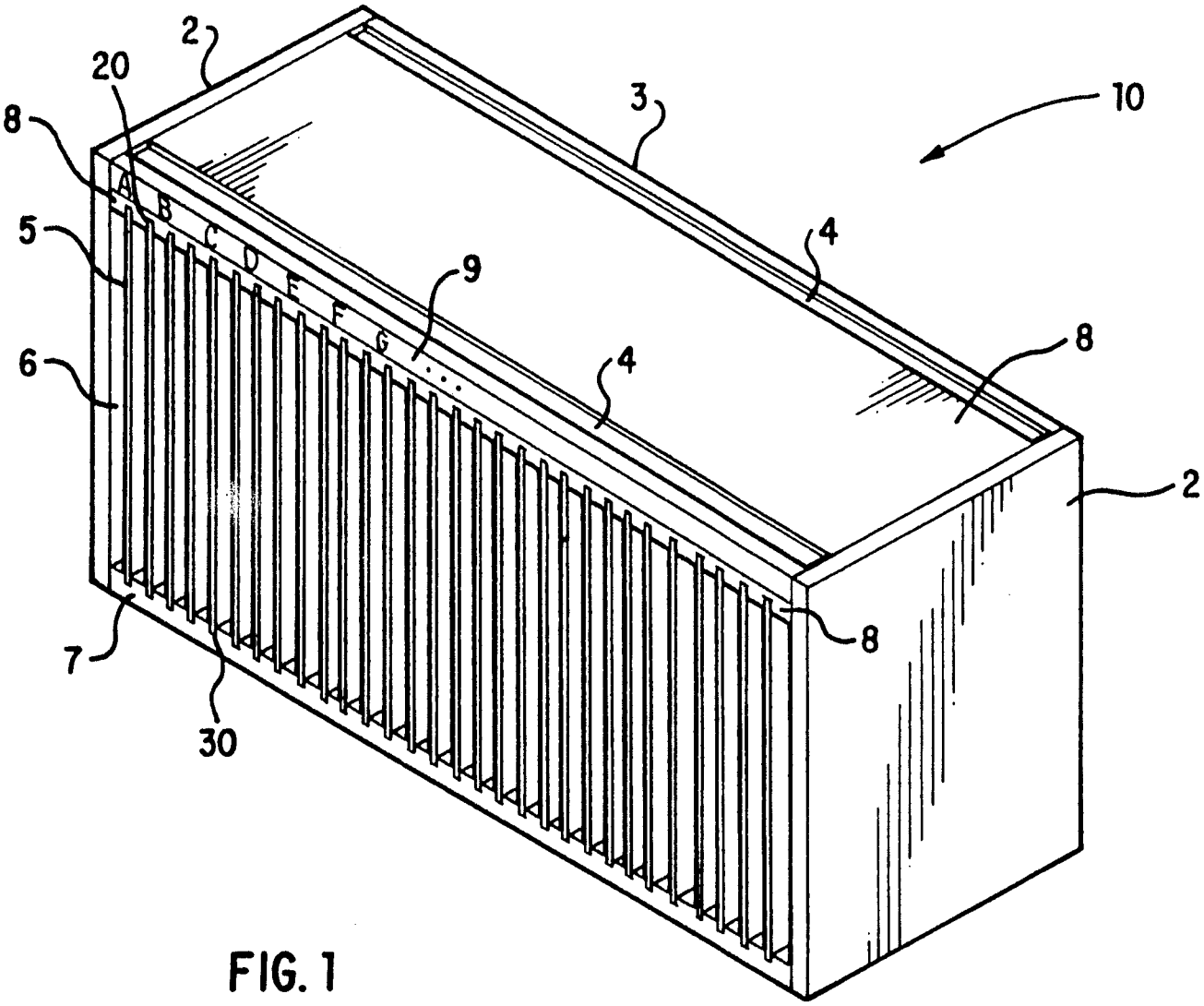
FIG. 1 is a top perspective view of a bookcase according to one embodiment of the present invention.
Figure 4:
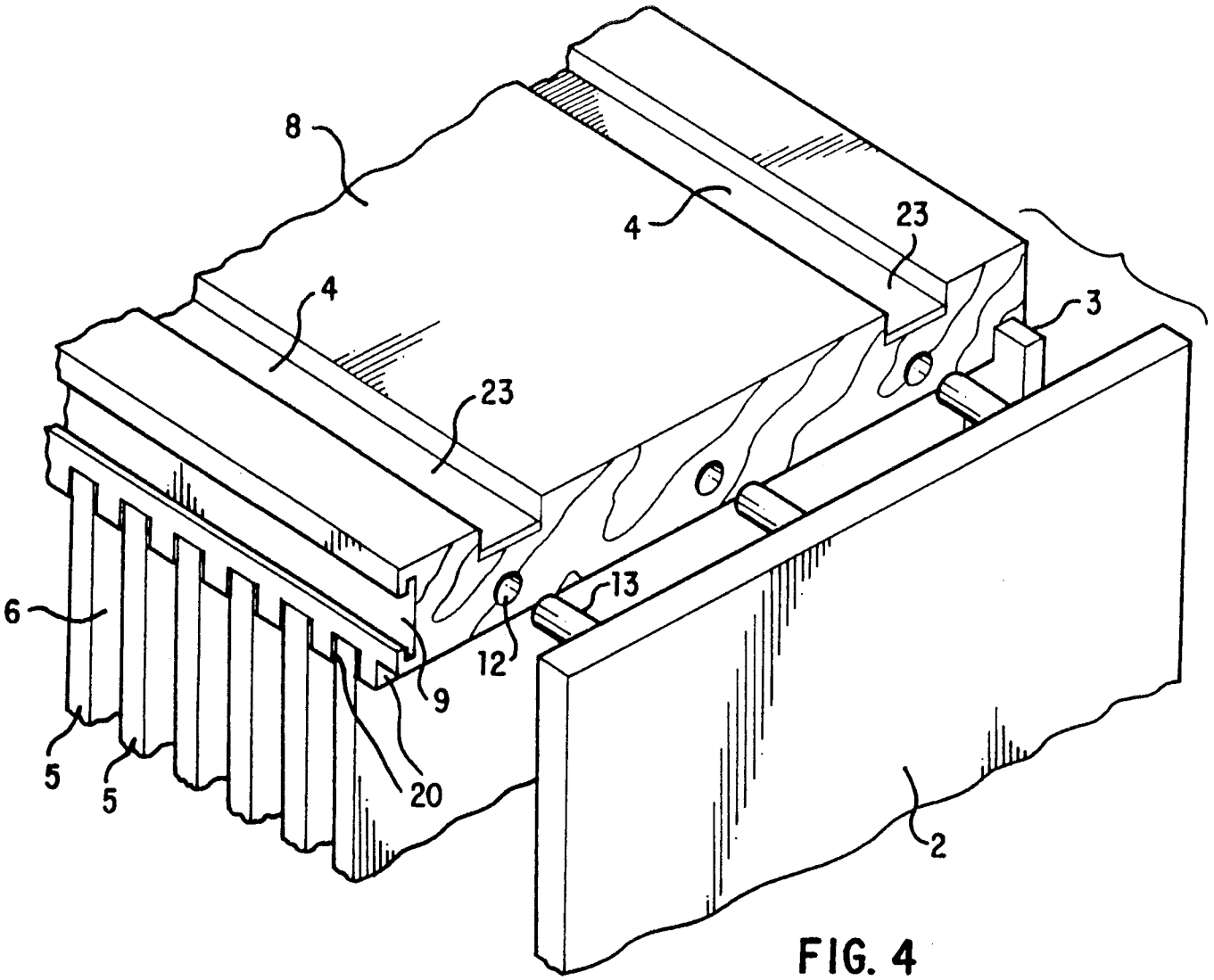
FIG. 4 is an exploded view of the top of the bookcase of FIG. 1 showing assembly of a side wall onto the top wall of the bookcase.

With reference to FIG. 1, there is shown a bookcase case 10 comprising sides 2, back panel 3, top wall 8, bottom wall 7, and dividers 5 defining storage spaces 6 therebetween. The bookcase is especially suited to house oversized books. The top wall 8 has formed on a lower surface thereof a plurality of notches 20 which extend from a front face of the bookcase 10 to the back panel 3 of the bookcase for retaining the top of the dividers 5. The bottom wall 7 has formed on an upper surface thereof a plurality of notches 30 extending from a front face of the bookcase 10 to the back panel 3 for retaining the bottom of the dividers 5. The top and bottom wall notches 20,30 are aligned so that dividers 5 retained between pairs of notches 20,30 are vertically oriented. Back panel 3 preferably is retained in notches 11 on the top and bottom walls 8,7 which extend transverse to the notches 20 used to retain the dividers 5. (See FIGS. 2 and 4.)

Figure 2:
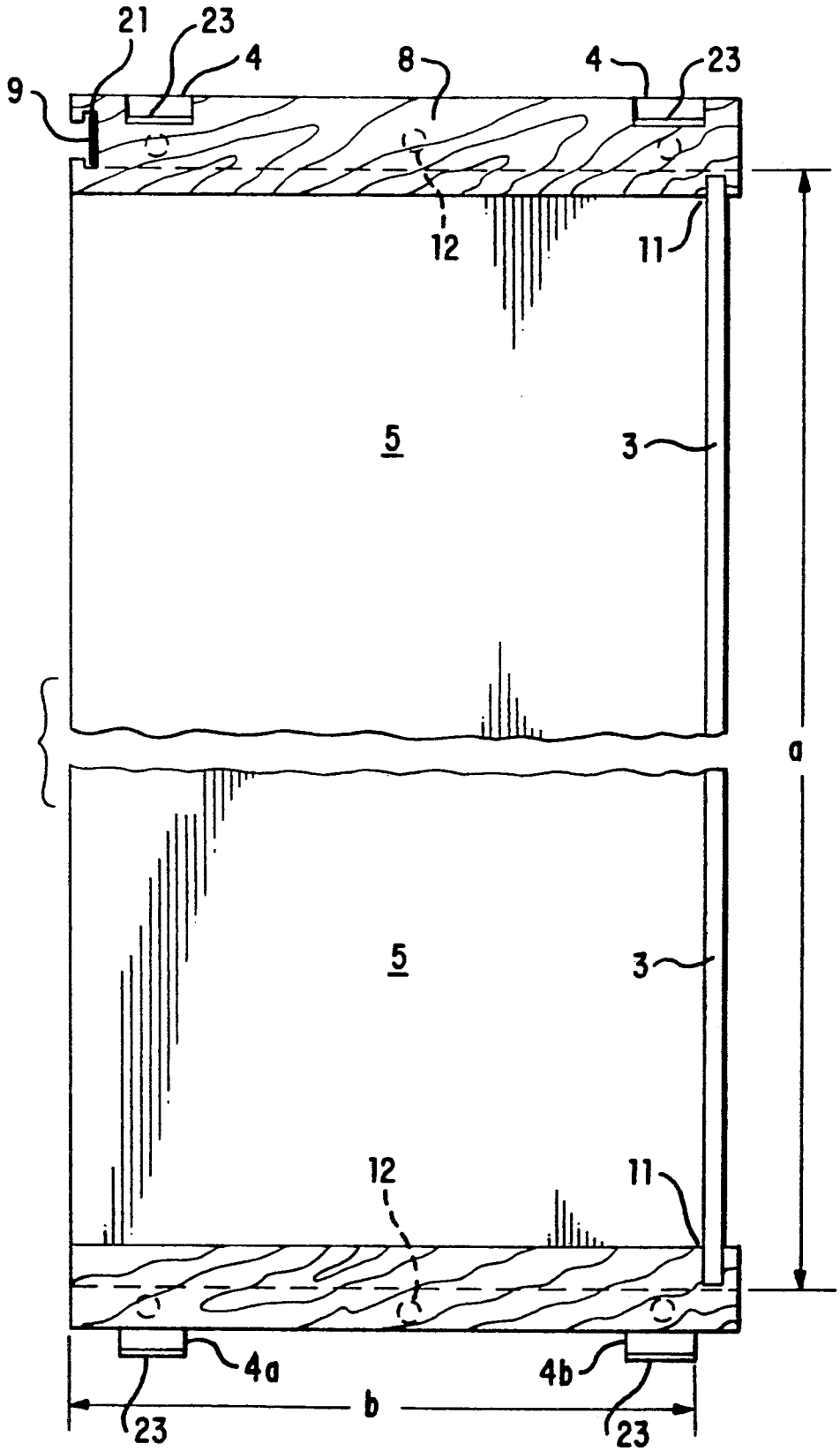
FIG. 2 is a side cross-sectional view of the bookcase of FIG. 1.

FIG. 2 shows a side cross-sectional view of the bookcase of FIG. 1. A front face of the top wall 8 includes a slot 9 for retaining an indicia strip 21. The indicia strip 21 may contain alphabetic, numeric or other indexing information from which the books stored in the bookcase can be easily identified for storage or retrieval. The indicia strip 21 can consist of thick paper material, cardboard, thin plastic or other material which can easily be formed to fit within slot 9 and which can have identifying information put thereon. The information may be printed on the strip by methods known in the art. The strip 21 has a height sufficient to allow adequate room for identifying information to be printed thereon for each storage area 6 located below. The slot 9 is sized to acommodate the indicia strip 21. Preferably, it is relatively thin in depth and extends substantially the entire width of the bookcase. By extending the slot 9 the entire width of the bookcase, the indicia strip 21 can readily be removed from either end. In the case of a small collection of books, it would suffice to have an alphabetical index of the books, as shown in FIG. 1. In the case of a larger collection, or in order to conform to standard library practice, the bookcase may be cataloged by the standard Dewey Decimal classification system or other systems known in the art.

Figure 5:
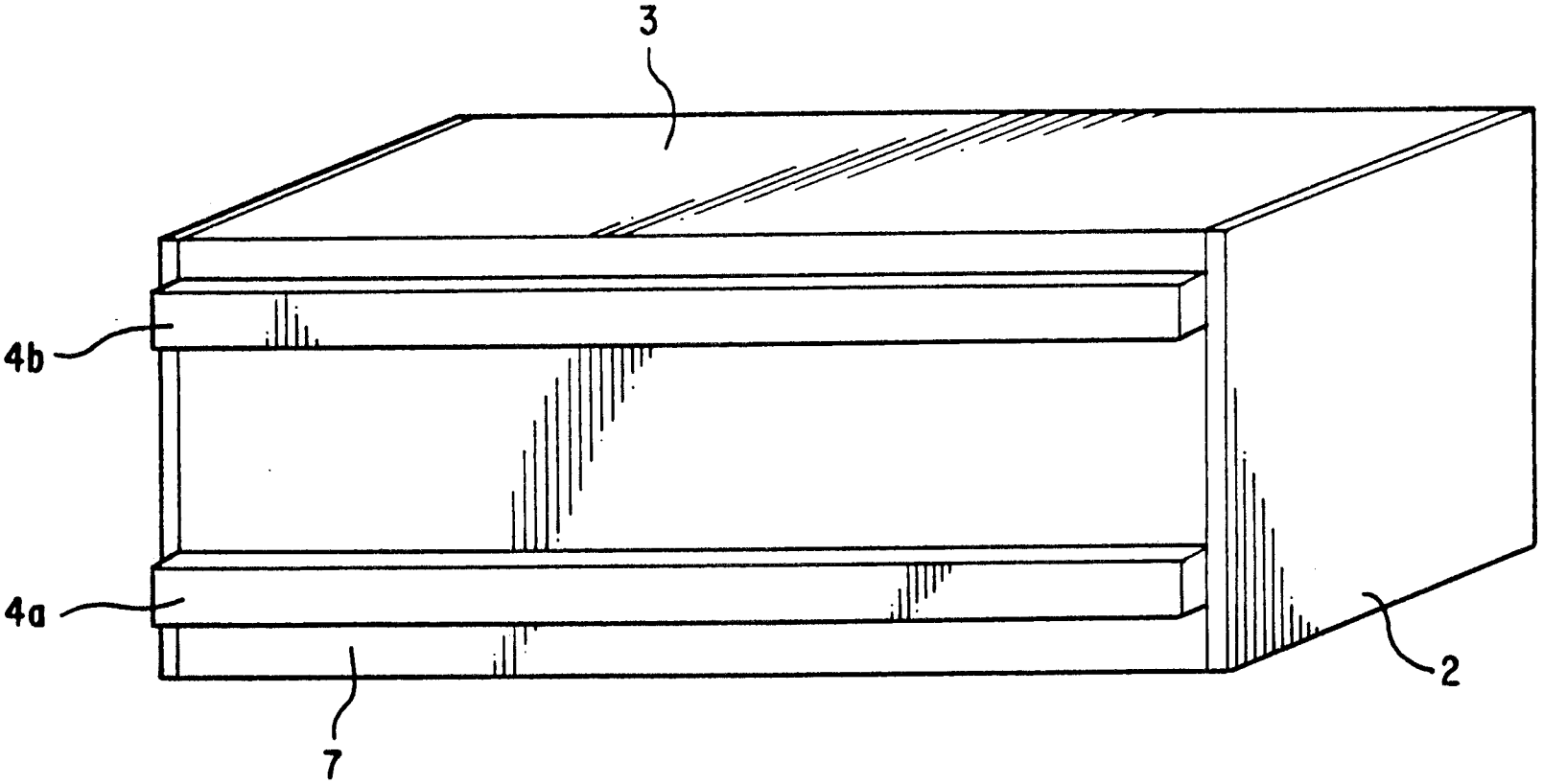
FIG. 5 is a bottom perspective view of a bookcase according to one embodiment of the present invention.

The bookcase preferably comprises legs 4*a* and 4*b*, which may or may not be integral with bottom wall 7, and grooves 4 molded or cut into top wall 8. The legs 4*a* and 4*b* provide stable support for a single bookcase unit or may be used in conjunction with grooves 4 when stacking multiple units to allow for aligning and stabilizing a plurality of the bookcases on top of one another. Legs 4*a* and 4*b* may be discrete legs at four or more locations on the bookcase, or may constitute long bars as shown in FIG. 5. The preferred grooves 4, as shown in FIG. 2, allow a top bookcase once lifted on top of a bottom bookcase to be easily aligned across the depth of the bookcase by moving the top bookcase until the legs 4*a* and 4*b* are in alignment with grooves 4 and the legs 4a,4b of the top bookcase drop into the grooves 4. The top bookcase can then be adjusted to vertically align the sides of the bookcases. The grooves 4 and legs 4a,4b preferably further comprise magnetic strips 23 on opposing portions thereof, as shown, to aid in retaining the legs 4a,4b and grooves 4 in alignment. The magnetic strips 23 can be attached to grooves 4 and legs 4a,4b by any known method. Preferably, the strips 23 comprise an adhesive backing layer which will fixedly mate the strips 23 with the grooves 4 and legs 4a,4b. Alternatively, dovetail grooves may be used for grooves 4 and the legs 4a and 4b may have a lower leg shape corresponding to the dovetail. This arrangement would allow for a more secure attachment of stacked bookcases, but would require the following steps: a bookcase to be stacked would be located alongside the bottom bookcase; the bookcase would be lifted adjacent to the bottom bookcase such that legs 4a and 4b of the top bookcase are in alignment with the dovetail grooves 4 of the bottom bookcase; and the top bookcase would be slid horizontally within the grooves 4 until the sides 2 of the cabinets are vertically aligned.

The bookcase may be made of any suitable material such as wood, metal or plastic. In the case of wood, the parts may be milled as known in the art. In the case of plastic or metal, the slot 9 and notches 20 may be molded, worked or machined as known in the art.

Figure 3:
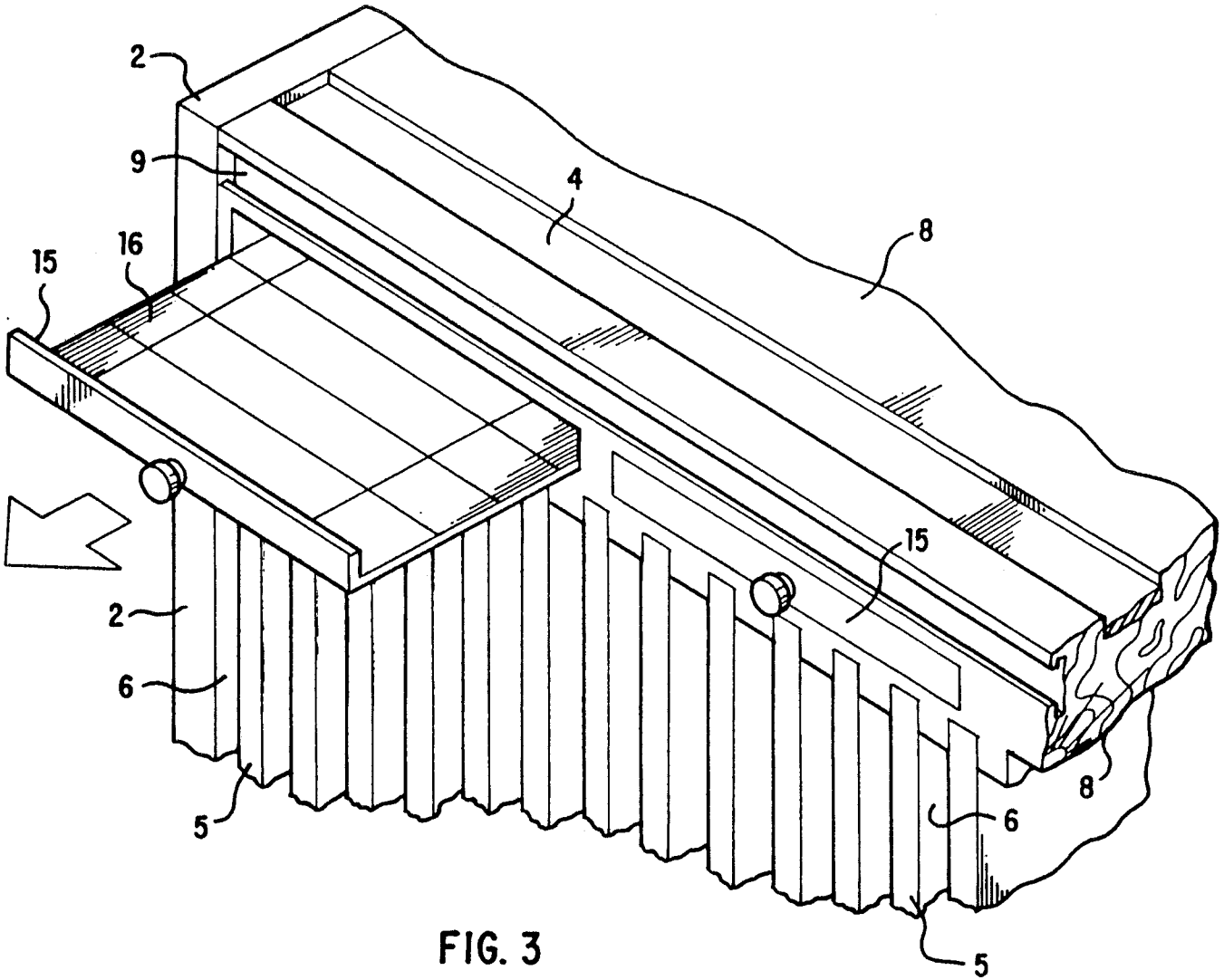
FIG. 3 is a top perspective view of an upper portion of a bookcase according to a preferred embodiment of the present invention.

FIG. 3 shows an alternative embodiment which includes the same basic elements as the previous embodiment, but adds drawers 15 located in the top wall 8 above the dividers 5. The drawers 15 are preferably narrow in height and can comprise a single wide drawer or a plurality of smaller drawers aligned side-by-side as shown. For example, there could be two to four or more symmetrically arranged drawers 15. The drawers 15 contain removable library information cards 16 which are used for indexing the books or materials which are housed in the bookcase. Upon review of the index of materials or books on the card, one can easily direct attention to an exact location in that bookcase for retrieval by using the indicia strip 21 to locate a specific storage space 6. The drawers may contain a plurality of indices such as ones arranged by author, subject, title, etc. so that various retrieval methods can be used.

Assembly of the bookcase may be performed by any manner known in the art such as gluing or nailing, but preferably the walls 2, 7 and 8 comprise bottomed holes 12 in which dowels 13 can be inserted and glued to retain the bookcase in an assembled state. (See FIG. 4.) Dividers 5 can be fastened in place (e.g., glued) or left movable so that the width of storage spaces 6 may be adjusted by selectively removing dividers 5.

Optionally, sliding front panels or hinged doors may be provided to fully enclose the books.

Oversized books are often up to 20"×15" and may be softbound or hardbound. Thus, the bookcase of the present invention preferably has storage spaces with height a and depth b dimensions slightly larger than 20"×15". The distance between adjacent notches 20,30 is preferably about 1 to 4 inches to provide adequate support and storage space. In a preferred embodiment, there are 25 dividers 5 to provide 26 storage spaces 6 (one for each letter of the alphabet). However, because more than one storage space 6 is often required for certain letters by which books may be indexed, a greater number of dividers and storage spaces is even more preferred. For example, FIG. 1 shows a bookcase with 30 dividers 5 and 31 storage spaces 6.

The invention has been described with reference to its preferred embodiments which are intended to be illustrative and not limiting. Various changes can be made without departing from the spirit or scope of the invention as described in the appended claims.

I claim:

1. A modular bookcase assembly comprising:

top, bottom and side walls to define a storage space therebetween;

a plurality of spaced vertical dividers arranged parallel to said side walls to further subdivide said storage space;

a plurality of notches in said top and bottom walls on a face adjacent said storage space, said notches extending parallel to said side walls and having a width approximately equal to a width of said dividers for retaining said dividers therewithin;

a removable indicia strip located on a front face of at least one of said top wall and said bottom wall, said indicia strip including indentifiers for various locations in said subdivided storage space;

a slot located on at least a front face of at least one of said top wall and said bottom wall for receiving and retaining said indicia strip;

groove members located on an external face of one of said bottom wall and said top wall, said groove members extending substantially the entire length of said one of said bottom wall and said top wall, and protrusion members located on an external face of the other one of said bottom wall and said top wall, said groove members and said protrusion members being capable of mating to securely retain said modular bookcase assembly in a vertically stacked relationship with other said modular bookcase assemblies; and a slidably extendable generally horizontal drawer located in said top wall for retaining a master catalog of items located in said storage space with references to locations identified by said identifiers.

2. The modular bookcase assembly of claim 1, further including magnetic means located on said groove members and said protrusions.

3. The modular bookcase assembly of claim 1, wherein said master catalog is located on a top face of said top wall.

4. The modular bookcase assembly of claim 1, wherein said storage space of said bookcase has a depth from 12 to 25 inches and a height from 12 to 30 inches.

5. The modular bookcase assembly of claim 1, wherein said storage space depth is from 14 to 17 inches and said height is from 17 to 23 inches.

6. The modular bookcase of claim 1, wherein said bookcase includes 1 to 4 drawers.

* * * * *